US010964445B2

(12) United States Patent
Myung et al.

(10) Patent No.: US 10,964,445 B2
(45) Date of Patent: Mar. 30, 2021

(54) HEATING ELEMENT AND MANUFACTURING METHOD THEREFOR

(71) Applicant: LG CHEM, LTD., Seoul (KR)

(72) Inventors: Ji Eun Myung, Daejeon (KR); Jooyeon Kim, Daejeon (KR); Seung Heon Lee, Daejeon (KR); Jiehyun Seong, Daejeon (KR); Kiseok Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 161 days.

(21) Appl. No.: 16/084,844

(22) PCT Filed: Dec. 23, 2016

(86) PCT No.: PCT/KR2016/015173

§ 371 (c)(1),
(2) Date: Sep. 13, 2018

(87) PCT Pub. No.: WO2017/217627

PCT Pub. Date: Dec. 21, 2017

(65) Prior Publication Data

US 2019/0074105 A1 Mar. 7, 2019

(30) Foreign Application Priority Data

Jun. 16, 2016 (KR) ..... 10-2016-0075220

(51) Int. Cl.
*H05B 3/18* (2006.01)
*H05B 3/20* (2006.01)
(Continued)

(52) U.S. Cl.
CPC ..... *H01B 5/14* (2013.01); *H05B 3/84* (2013.01); *H05B 2203/01* (2013.01); *H05B 2203/013* (2013.01); *H05B 2203/017* (2013.01)

(58) Field of Classification Search
CPC ..... H05B 2203/013; H05B 2203/031; H05B 2203/032; H05B 1/0236; H05B 3/14;
(Continued)

(56) References Cited

U.S. PATENT DOCUMENTS 4,361,751 A * 11/1982 Criss ..... B32B 17/10 174/257
4,587,402 A * 5/1986 Nishino ..... H05B 3/283 338/308
(Continued)

FOREIGN PATENT DOCUMENTS

CN 200976685 Y 11/2007
CN 101340752 A 1/2009
(Continued)

*Primary Examiner* — Michael A Laflame, Jr.
(74) *Attorney, Agent, or Firm* — Dentons US LLP

(57) ABSTRACT

The present disclosure relates to a method for manufacturing a heating element, which includes the steps of: preparing a first bonding film; forming a conductive heating pattern on the first bonding film; and laminating a second bonding film and a transparent substrate on the first bonding film, where the second bonding film is disposed on a surface opposite to the surface provided with the conductive heating pattern of the first bonding film, and the conductive heating pattern is formed by using an adhesive film having an adhesive strength decrement of 30% or greater by an external stimulus based on adhesive strength before the external stimulus.

4 Claims, 3 Drawing Sheets

(51) Int. Cl.

| | |
|---|---|
| ***H05B 3/28*** | (2006.01) |
| ***H05B 3/84*** | (2006.01) |
| ***H01B 5/14*** | (2006.01) |

(58) Field of Classification Search
CPC ..... H05B 3/16; H05B 3/18; H05B 3/20–262; H05B 3/28; H05B 3/84
See application file for complete search history.

(56) References Cited

U.S. PATENT DOCUMENTS

| | | | | |
|---|---|---|---|---|
| 5,493,102 | A * | 2/1996 | Takase | B32B 17/10 219/547 |
| 10,327,285 | B2 * | 6/2019 | Seong | H05B 3/0047 |
| 2005/0215073 | A1 | 9/2005 | Nakamura et al. | |
| 2007/0187382 | A1 * | 8/2007 | Mauser | B32B 17/10036 219/203 |
| 2009/0218333 | A1 | 9/2009 | Kaastra | |
| 2010/0021683 | A1 | 1/2010 | Junghans et al. | |
| 2010/0170889 | A1 * | 7/2010 | Keite-Telgenbuscher | C09J 7/10 219/546 |
| 2012/0261404 | A1 | 10/2012 | Choi et al. | |
| 2013/0075383 | A1 | 3/2013 | Kim | |
| 2013/0228365 | A1 | 9/2013 | Uprety et al. | |
| 2016/0141223 | A1 | 5/2016 | Aramaki et al. | |
| 2016/0278166 | A1 | 9/2016 | Seong et al. | |
| 2016/0347028 | A1 * | 12/2016 | Kosaka | H05B 3/84 |
| 2017/0238373 | A1 * | 8/2017 | Kim | H05B 3/84 219/203 |
| 2017/0245326 | A1 * | 8/2017 | Rivat | D06N 3/042 |
| 2019/0297677 | A1 * | 9/2019 | Ito | H05B 3/36 |
| 2019/0297679 | A1 * | 9/2019 | Gima | H05B 3/84 |
| 2020/0230923 | A1 * | 7/2020 | Nishioka | B60J 1/00 |

FOREIGN PATENT DOCUMENTS

| | | | |
|---|---|---|---|
| CN | 102160456 | A | 8/2011 |
| CN | 102687586 | A | 9/2012 |
| EP | 1170345 | A2 | 1/2002 |
| JP | 10178255 | A | 6/1998 |
| JP | 2005-277074 | A | 10/2005 |
| JP | 2008077879 | A | 4/2008 |
| JP | 2013069835 | A | 4/2013 |
| JP | 5766335 | B2 | 8/2015 |
| JP | 2015168711 | A | 9/2015 |
| KR | 10-1579869 | B1 | 1/2006 |
| KR | 10-0964028 | B1 | 6/2010 |
| KR | 10-2010-0135568 | A | 12/2010 |
| KR | 10-1089631 | B1 | 12/2011 |
| KR | 10-2013-0032659 | A | 4/2013 |
| KR | 10-2015-0062984 | A | 6/2015 |
| KR | 10-2016-0002246 | A | 1/2016 |
| WO | 2010008279 | A1 | 1/2010 |

* cited by examiner

【FIG. 1】
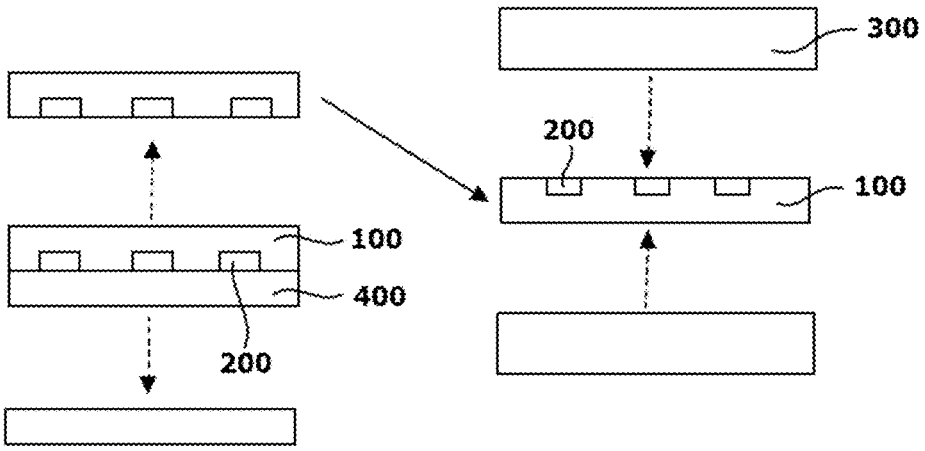
【FIG. 2】
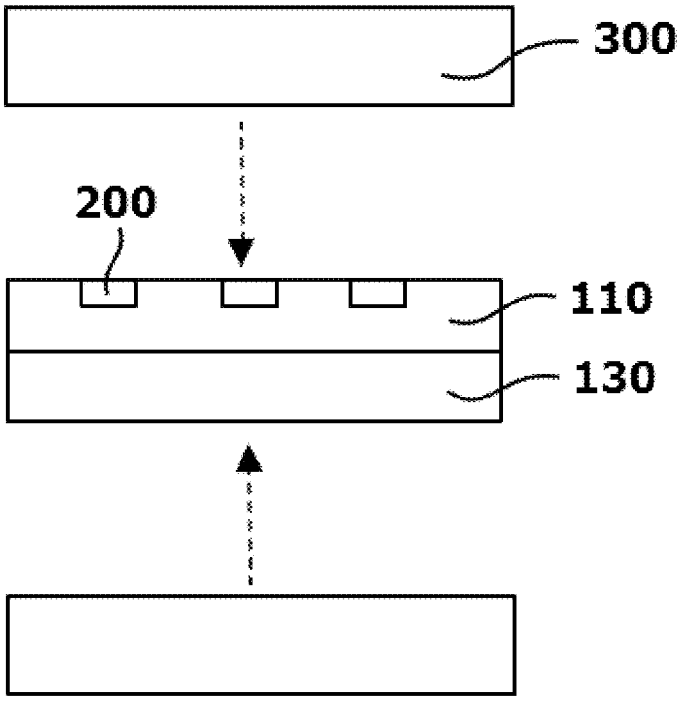

【FIG. 3】
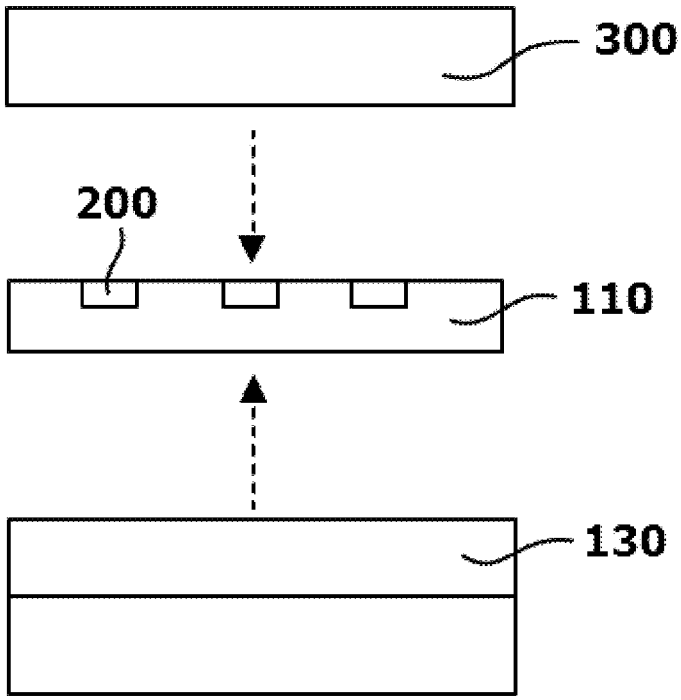
【FIG. 4】
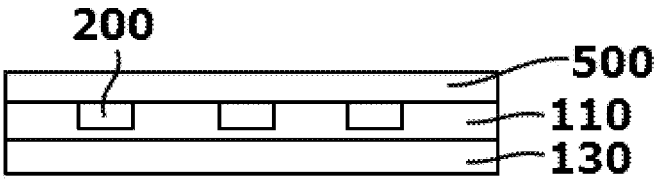
【FIG. 5】
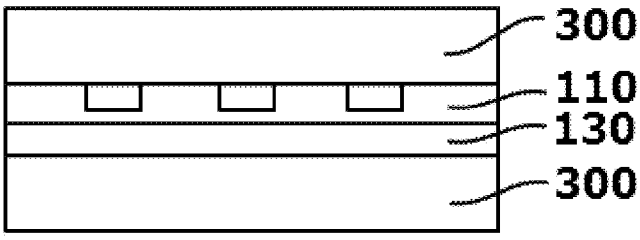
【FIG. 6】
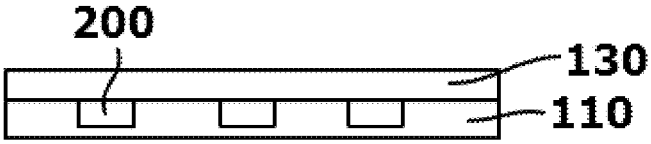

【FIG. 7】
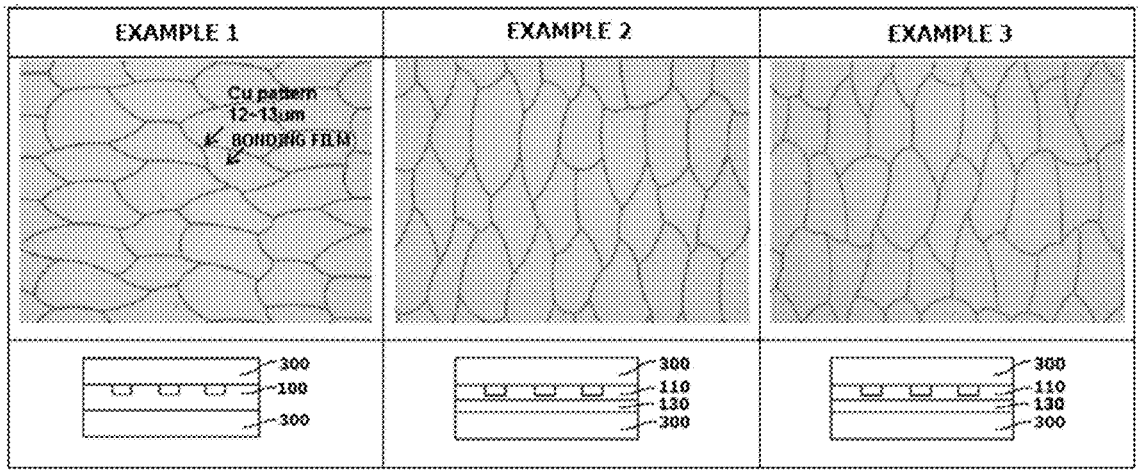

HEATING ELEMENT AND MANUFACTURING METHOD THEREFOR

TECHNICAL FIELD

This application is a National Stage Entry of International Application No. PCT/KR2016/015173, filed on Dec. 23, 2016, and claims the benefit of and priority to Korean Application No. 10-2016-0075220, filed on Jun. 16, 2016, all of which are hereby incorporated by reference in their entirety for all purposes as if fully set forth herein.

The present specification describes a heating element and a method for manufacturing the same.

BACKGROUND ART

Moisture or frost is formed on automotive glass when there is a temperature difference between outside and inside the automobile. Heating glass may be used in order to solve this problem. Heating glass uses a concept of forming a heating line by attaching a heating line sheet on the glass surface or directly forming a heating line on the glass surface, generating heat from the heating line by applying electricity to both terminals of the heating line, and increasing a temperature of the glass surface therefrom.

Particularly, methods employed for providing heating while having excellent optical performance to automotive front glass are largely divided into two types.

The first method is forming a transparent conductive thin film on the whole glass surface. The method of forming a transparent conductive thin film includes a method of using a transparent conductive oxide film such as ITO, or by forming a thin metal layer and then using transparent insulation films above and below the metal layer to increase transparency. This method has an advantage in that an optically superior conductive film may be formed, however, there is a disadvantage in that a proper heating value may not be obtained at low voltages due to a relatively high resistance value.

The second method may use a method of using a metal pattern or wire, and increasing transparency by maximizing a region having no patterns or wires. Typical products using this method include heating glass produced by inserting a tungsten wire to a PVB film used for bonding automotive front glass. In this method, the diameter of the used tungsten wire is 18 micrometers or greater, and conductivity capable of securing a sufficient heating value at low voltages may be obtained, however, there is a disadvantage in that the tungsten line is visually noticeable due to the relatively thick tungsten line. In order to overcome this problem, a metal pattern may be formed on a PET film through a printing process, or a metal pattern may be formed through a photolithography process after attaching a metal layer on a polyethylene terephthalate (PET) film. A heating product capable of heating may be produced by inserting the metal pattern-formed PET film between two polyvinyl butyral (PVB) films, and then going through a glass bonding process. However, there is a disadvantage in that, by a PET film being inserted between two PVB films, there may be a distortion in the objects seen through automotive glass due to refractive index differences between the PET film and the PVB film.

DISCLOSURE

Technical Problem

The present specification is directed to providing a heating element and a method for manufacturing the same.

Technical Solution

One embodiment of the present specification provides a method for manufacturing a heating element including preparing a bonding film; forming a conductive heating pattern on the bonding film; and laminating a transparent substrate on at least one surface of the bonding film provided with the conductive heating pattern.

Another embodiment of the present specification provides a heating element including a bonding film; and a conductive heating pattern provided on the bonding film.

Advantageous Effects

According to embodiments described in the present specification, a conductive heating pattern can be formed on a transparent substrate of an end product so that the transparent substrate for forming the conductive heating pattern does not remain in the end product. As above, by an adhesive film for forming a conductive heating pattern being removed, films other than a bonding film may not be additionally used between two transparent substrates of an end product, and view distortions caused by refractive index differences between the films can be prevented.

DESCRIPTION OF DRAWINGS

FIG. 1 illustrates a method for manufacturing a heating element according to a first embodiment of the present specification.

FIG. 2 illustrates a method for manufacturing a heating element according to a second embodiment of the present specification.

FIG. 3 illustrates a method for manufacturing a heating element according to a third embodiment of the present specification.

FIG. 4 illustrates a structure of a heating element according to a fourth embodiment of the present specification.

FIG. 5 illustrates a structure of a heating element according to a fifth embodiment of the present specification.

FIG. 6 illustrates a structure of a heating element according to a sixth embodiment of the present specification.

FIG. 7 shows optical microscope images of heating elements manufactured in Examples 1 to 3.

REFERENCE NUMERAL

100: Bonding Film
110: First Bonding film
130: Second Bonding film
200: Conductive Heating Pattern
300: Transparent Substrate
400: Adhesive film
500: Release Film

MODE FOR DISCLOSURE

Hereinafter, the present specification will be described in detail.

A method for manufacturing a heating element according to one embodiment of the present specification provides includes preparing a bonding film; forming a conductive heating pattern on the bonding film; and laminating a transparent substrate on at least one surface of the bonding film provided with the conductive heating pattern.

The preparing of a bonding film may be preparing a bonding film by purchasing the film from the outside, or making a bonding film.

The bonding film may further include a release film provided on at least one surface. When providing a release film on both surfaces of the bonding film, the release film on only the side to form a conductive heating pattern may be removed, and on the release film-removed surface, a conductive heating pattern may be formed. The remaining release film may be removed later after laminating the conductive heating pattern-provided bonding film on a transparent substrate of an end product.

The bonding film means having a bonding property at a process temperature or higher used in a thermal bonding process. For example, the bonding film means those capable of exhibiting a bonding property with a transparent substrate in a thermal bonding process used for manufacturing a heating element in the art. Pressures, temperatures and times of the thermal bonding process vary depending on the types of the bonding film, however, the thermal bonding process may go through, for example, first bonding at a low temperature of higher than or equal to 50° C. and lower than or equal to 100° C., and then second bonding at a high temperature of higher than 100° C., or bonding at once at a temperature selected in a range of 130° C. to 150° C., and a pressure may be applied as necessary. As materials of the bonding film, polyvinyl butyral (PVB), ethylene vinyl acetate (EVA), polyurethane (PU), polyolefin (PO) and the like may be used, however, the material is not limited to these examples.

The bonding film has a bonding property at a process temperature or higher used in a thermal bonding process, and therefore, an additional bonding film is not required when bonding with a transparent substrate later.

According to one embodiment of the present disclosure, the bonding film has a thickness of greater than or equal to 190 μm and less than or equal to 2,000 μm. When the bonding film has a thickness of 190 μm or greater, the bonding film yields sufficient bonding strength with the transparent substrate later while stably supporting the conductive heating pattern. When the bonding film has a thickness of 2,000 μm or less, sufficient supporting property and bonding property are obtained and an unnecessary thickness increase may be prevented.

According to one embodiment of the present disclosure, the bonding film has a glass transition temperature (Tg) of higher than or equal to 55° C. and lower than or equal to 90° C. Even when the bonding film has such a low glass transition temperature (Tg), a conductive heating pattern may be formed without damages on the bonding property of the bonding film, or without unintended deformation or damages on the film in a conductive heating pattern forming process using a method described below.

The forming of a conductive heating pattern on the bonding film may include preparing an adhesive film provided with a conductive heating pattern and having an adhesive strength decrement of 30% or greater by an external stimulus based on adhesive strength before the external stimulus; bonding the conductive heating pattern on the bonding film by laminating the conductive heating pattern-provided adhesive film on the bonding film; applying an external stimulus to the adhesive film; and removing the adhesive film.

The preparing of an adhesive film may include forming an adhesive film on a substrate; and forming a conductive heating pattern on the adhesive film.

The adhesive film supports a metal film or a metal pattern before applying an external stimulus and needs to have no decoating or defects, and has adhesive strength reduced by an external stimulus afterward and needs to have favorable metal pattern transferability.

When forming a conductive heating pattern using an etching process after forming a metal film on the adhesive film, the adhesive film needs to have acid resistance and base resistance for an etching solution etching the metal film and a peel-off solution peeling off an etching protective pattern. Herein, acid resistance and base resistance of the adhesive film are determined by the adhesive film not going through visually observed color changes after being impregnated in the etching solution or the peel-off solution, all or a part thereof being not removed with dissolution, and whether the adhesive film maintains the same level of adhesive strength compared to the beginning.

The adhesive film is a film having adhesive strength controlled by an external stimulus, and specifically, may be a film having adhesive strength decreased by an external stimulus. The adhesive film may have an adhesive strength decrement of 30% or greater by an external stimulus based on adhesive strength before the external stimulus, and specifically, the adhesive film may have an adhesive strength decrement of greater than or equal to 30% and less than or equal to 100% by an external stimulus based on adhesive strength before the external stimulus, and more specifically, the adhesive film may have an adhesive strength decrement of greater than or equal to 50% and less than or equal to 100% and more favorably greater than or equal to 70% and less than or equal to 100% by an external stimulus based on adhesive strength before the external stimulus.

The adhesive film may have initial adhesive strength of 20 to 2000 (180°, gf/25 mm), and the adhesive strength of the adhesive film may be reduced to 1 to 100 (180°, gf/25 mm) by an external stimulus. Herein, adhesive strength of the adhesive film is measured using a 180° peel test measuring method, and specifically, is measured under a condition of a 180° angle and a 300 mm/s rate at room temperature. The specimen for the measurement is prepared by forming a metal film on an adhesive film and cutting the result to have a width of 25 mm, and force (gf/25 mm) peeling off the adhesive film from the metal film is measured.

The thickness of the adhesive film is not particularly limited, however, adhesion efficiency is reduced as the adhesive film thickness decreases. The adhesive film may have a thickness of greater than or equal to 5 μm and less than or equal to 100 μm.

The forming of an adhesive film on the substrate may include forming an adhesive layer on a substrate using an adhesive composition.

The adhesive composition may include an adhesive resin, an initiator and a crosslinking agent.

The crosslinking agent may include one or more types of compounds selected from the group consisting of isocyanate-based compounds, aziridine-based compounds, epoxy-based compounds and metal chelate-based compounds. The adhesive composition may include the crosslinking agent in 0.1 parts by weight to 40 parts by weight with respect to 100 parts by weight of the adhesive resin. When the crosslinking agent content is too low, cohesiveness of the adhesive film may be insufficient, and when the crosslinking agent content is too high, adhesive strength of the adhesive film is not sufficiently secured before photocuring.

Specific examples of the initiator are not limited, and commonly known initiators may be used. In addition, the adhesive composition may include the initiator in 0.1 parts by weight to 20 parts by weight with respect to 100 parts by weight of the adhesive resin.

The adhesive resin may include (meth)acrylate-based resins having a weight average molecular weight of 400,000 to 2,000,000.

In the present specification, (meth)acrylate means including both acrylate and methacrylate. Examples of the (meth) acrylate-based resin may include copolymers of (meth) acrylic acid ester-based monomers and crosslinking functional group-containing monomers.

The (meth)acrylic acid ester-based monomer is not particularly limited, and examples thereof may include alkyl (meth)acrylates, and more specifically, may include, as a monomer having an alkyl group with 1 to 12 carbon atoms, one, two or more types among pentyl (meth)acrylate, n-butyl (meth)acrylate, ethyl (meth)acrylate, methyl (meth)acrylate, hexyl (meth)acrylate, n-octyl (meth)acrylate, isooctyl (meth) acrylate, 2-ethylhexyl (meth) acrylate, dodecyl (meth)acrylate and decyl (meth)acrylate.

The crosslinking functional group-containing monomer is not particularly limited, and examples thereof may include one, two or more types among hydroxyl group-containing monomers, carboxyl group-containing monomers and nitrogen-containing monomers.

Examples of the hydroxyl group-containing compound may include 2-hydroxyethyl (meth)acrylate, 2-hydroxypropyl (meth) acrylate, 4-hydroxybutyl (meth) acrylate, 6-hydroxyhexyl (meth) acrylate, 8-hydroxyoctyl (meth) acrylate, 2-hydroxyethylene glycol (meth) acrylate, 2-hydroxypropylene glycol (meth)acrylate or the like.

Examples of the carboxyl group-containing compound may include (meth)acrylic acid, 2-(meth)acryloyloxyacetic acid, 3-(meth)acryloyloxypropionic acid, 4-(meth)acryloyloxybutyric acid, acrylic acid dimers, itaconic acid, maleic acid, maleic anhydride or the like.

Examples of the nitrogen-containing monomer may include (meth)acrylonitrile, N-vinyl pyrrolidone, N-vinyl caprolactam or the like.

To the (meth)acrylate-based resin, at least one of vinyl acetate, styrene and acrylonitrile may be additionally copolymerized in terms of enhancing other functionalities such as compatibility.

The adhesive composition may further include an ultraviolet curable compound. Types of the ultraviolet curable compound are not particularly limited, and, for example, multifunctional compounds having a weight average molecular weight of 500 to 300,000 may be used. Those having average knowledge in the art may readily select proper compounds depending on target applications. The ultraviolet curable compound may include multifunctional compounds having two or more ethylenically unsaturated double bonds.

The content of the ultraviolet curable compound may be from 1 part by weight to 400 parts by weight and preferably from 5 parts by weight to 200 parts by weight with respect to 100 parts by weight of the adhesive resin described above.

When the content of the ultraviolet curable compound is less than 1 part by weight, an adhesive strength decrease after curing is not sufficient causing concern of declining a transfer property, and the content being greater than 400 parts by weight may cause concern that cohesiveness of an adhesive before ultraviolet irradiation may be insufficient or peel-off with a release film and the like may not be readily achieved.

The ultraviolet curable compound may also be used in a form of carbon-carbon double bonds bonding to a side chain or main chain end of a (meth)acrylic copolymer of the adhesive resin as well as the addition-type ultraviolet curable compound. In other words, the ultraviolet curable compound may be introduced to a side chain of a (meth) acryl-based copolymer, the adhesive resin, by introducing the ultraviolet curable compound to a monomer for polymerizing a (meth)acryl-based copolymer, the adhesive resin, such as a (meth)acrylic acid ester-based monomer and a crosslinking functional group-containing monomer, or by additionally reacting the ultraviolet curable compound to the polymerized (meth)acryl-based copolymer.

Types of the ultraviolet curable compound are not particularly limited as long as it includes 1 to 5 and preferably 1 or 2 ethylenically unsaturated double bonds per one molecule, and has a functional group capable of reacting with a crosslinking functional group included in a (meth) acryl-based copolymer, the adhesive resin. Herein, examples of the functional group capable of reacting with a crosslinking functional group included in a (meth)acryl-based copolymer, the adhesive resin, may include an isocyanate group, an epoxy group or the like, but are not limited thereto.

Specific examples of the ultraviolet curable compound may include one, two or more types of, as those including a functional group capable of reacting with a hydroxyl group of the adhesive resin, (meth)acryloyloxy isocyanate, (meth) acryloyloxymethyl isocyanate, 2-(meth)acryloyloxyethyl isocyanate, 3-(meth)acryloyloxypropyl isocyanate, 4-(meth) acryloyloxybutyl isocyanate, m-propenyl-$\alpha,\alpha$-dimethylbenzyl isocyanate, methacryloyl isocyanate or allyl isocyanate;

acryloyl monoisocyanate compounds obtained by reacting diisocyanate compounds or polyisocyanate compounds with (meth)acrylic acid 2-hydroxyethyl;

acryloyl monoisocyanate compounds obtained by reacting diisocyanate compounds or polyisocyanate compounds, polyol compounds and (meth)acrylic acid 2-hydroxyethyl; or as those including a functional group capable of reacting with a carboxyl group of the adhesive resin, glycidyl (meth) acrylate, allyl glycidyl ether or the like, however, the ultraviolet curable compound is not limited thereto.

The ultraviolet curable compound may be included in a side chain of the adhesive resin by substituting 5 mol % to 90 mol % of a crosslinking functional group of the adhesive resin. When the amount of substitution is less than 5 mol %, a decrease in the peel-off strength caused by ultraviolet irradiation may not be sufficient, and when the amount of substitution is greater than 90 mol %, cohesiveness of the adhesive before ultraviolet irradiation may be reduced.

The adhesive composition may properly include a tackifier such as a rosin resin, a terpene resin, a phenol resin, a styrene resin, an aliphatic petroleum resin, an aromatic petroleum resin or an aliphatic aromatic copolymerized petroleum resin.

A method forming the adhesive film on a substrate is not particularly limited, and for example, may use a method of forming an adhesive film by directly coating the adhesive composition of the present disclosure on a substrate, a method of preparing an adhesive film by coating the adhesive composition on a detachable substrate first and then transferring the adhesive film on a substrate using the detachable substrate, or the like.

Methods of coating and drying the adhesive composition are not particularly limited, and for example, a method of coating a composition including each of the components as it is or as being dissolved in a proper organic solvent using known means such as a comma coater, a gravure coater, a die coater or a reverse coater, and drying the solvent for 10 seconds to 30 minutes at a temperature of 60° C. to 200° C. may be used. In addition, in the above-mentioned process, an aging process may be additionally performed for sufficiently progressing a crosslinking reaction of the adhesive.

The substrate performs a role of supporting the adhesive film, and may be removed with the adhesive film when removing the adhesive film.

Materials of the substrate are not particularly limited as long as it is capable of performing a role of supporting the adhesive film, and for example, the substrate may be a glass substrate or a flexible substrate. Specifically, the flexible substrate may be a plastic substrate or a plastic film. The plastic substrate or the plastic film is not particularly limited, and examples thereof may include any one or more of polyacrylate, polypropylene (PP), polyethylene terephthalate (PET), polyethylene ether phthalate, polyethylene phthalate, polybuthylene phthalate, polyethylene naphthalate (PEN), polycarbonate (PC), polystyrene (PS), polyether imide, polyether sulfone, polydimethyl siloxane (PDMS), polyetheretherketone (PEEK) and polyimide (PI).

The substrate being a flexible film has an advantage in that the adhesive film or the conductive heating pattern-provided adhesive film may be wound in a roll and stored so as to be used in a roll-to-roll process.

The thickness of the substrate is not particularly limited, and specifically, may be greater than or equal to 20 μm and less than or equal to 250 μm.

The preparing of an adhesive film includes forming a conductive heating pattern on the adhesive film.

The conductive heating pattern may be formed by forming a metal film on at least one surface of the adhesive film and then patterning the metal film, or may be formed by transferring a patterned metal pattern on the adhesive film.

The metal film may be formed using methods of deposition, plating, metal foil lamination and the like, and a conductive heating pattern may be formed by forming an etching protective pattern on the metal film using photolithography, an inkjet method, a plate printing method, a roll printing method or the like, and then etching the metal film that is not covered by the etching protective pattern.

The conductive heating pattern may be formed by directly transferring a patterned metal pattern on the adhesive film. Herein, the patterned metal pattern may be formed using lamination of metal pattern-provided metal foil or a roll printing method.

The line height of the conductive heating pattern may be 10 μm or less. The conductive heating pattern having a line height of greater than 10 μm has a disadvantage of increasing metal awareness by light reflection due to a side surface of the metal pattern. According to one embodiment of the present disclosure, the line height of the conductive heating pattern is in a range of greater than or equal to 0.3 μm and less than or equal to 10 μm. According to one embodiment of the present disclosure, the line height of the conductive heating pattern is in a range of greater than or equal to 0.5 μm and less than or equal to 5 μm.

In the present specification, the line height of the conductive heating pattern means a distance from a surface adjoining the adhesive film to a surface opposite thereto.

According to one embodiment of the present disclosure, the conductive heating pattern has a line height deviation of 20% or less and preferably 10% or less. Herein, the deviation means a percentage for a difference between an average line height and an individual line height based on the average line height.

The conductive heating pattern may be formed with thermally conductive materials. For example, the conductive heating pattern may be formed with metallic lines. Specifically, the heating pattern preferably includes metals having excellent thermal conductivity. The heating pattern material favorably has a specific resistance value of greater than or equal to 1 microOhm cm and less than or equal to 200 microOhm cm. Specific examples of the heating pattern material may include copper, silver, aluminum and the like. As the conductive heating pattern material, copper that is inexpensive and has excellent electrical conductivity is most preferred.

The conductive heating pattern may include a pattern of metallic lines formed with straight lines, curves, zigzags or combinations thereof. The conductive heating pattern may include regular patterns, irregular patterns or combinations thereof.

The total aperture ratio of the conductive heating pattern, that is, a proportion of the substrate region that is not covered by the conductive heating pattern is preferably 90% or greater.

The conductive heating pattern has a line width of 40 μm or less, and specifically 0.1 μm to 40 μm. The conductive heating pattern has line to line spacing of 50 μm to 30 mm.

The method for manufacturing a heating element may further include forming a darkening pattern at least one of before and after the forming of a conductive heating pattern on the adhesive film.

The darkening pattern may be provided in a region corresponding to the conductive heating pattern, may specifically be provided on an upper surface and/or a lower surface of the conductive heating pattern, may be provided on at least a part of a side surface as well as on an upper surface and a lower surface of the conductive heating pattern, and may be provided on the whole upper surface, lower surface and side surface of the conductive heating pattern.

In the present specification, by providing the darkening pattern on an upper surface and/or a lower surface of the conductive heating pattern, reflectivity-dependent visibility of the conductive heating pattern may be reduced.

In the present specification, the darkening pattern may be patterned either together with or separately from the conductive heating pattern, however, layers for forming each pattern are separately formed. However, in order for the conductive heating pattern and the darkening pattern to be present on surfaces precisely corresponding to each other, the conductive pattern and the darkening pattern are most preferably formed at the same time.

In the present specification, the darkening pattern and the conductive heating pattern are distinguished from structures in which at least some of light-absorbing materials are sunk or dispersed into the conductive heating pattern, or structures in which a part of a surface side is physically or chemically modified by surface treatment of a single conductive layer in that separate pattern layers form a lamination structure.

In addition, in the present specification, the darkening pattern is provided directly on the adhesive film or directly on the conductive pattern without interposing an additional bonding layer or adhesive layer.

The darkening pattern may be formed in a single layer or may be formed in a multiple layer of two or more layers.

The darkening pattern is preferably close to colors of achromatic color series. However, the darkening pattern is not necessarily an achromatic color, and may be introduced when having low reflectivity even when having colors. Herein, the color of achromatic color series means a color appearing when light entering on a surface of an object is evenly reflected and absorbed for wavelengths of each component without being selectively absorbed. In the present specification, as the darkening pattern, materials having a total reflection standard deviation for each wavelength range of 50% or less when measuring total reflection in a visible region (400 nm to 800 nm) may be used.

As materials of the darkening pattern, black dyes, black pigments, metals, metal oxides, metal nitrides or metal oxynitrides having the physical properties described above when forming a front surface layer may be preferably used without particular limit as a light absorbing material. For example, the darkening pattern may be formed with a photolithography method, an ink jet method, a printing method, a roll printing method or the like using a composition including black dyes or black pigments, or may be formed by pattering an oxide film, a nitride film, an oxide-nitride film, a carbide film, a metal film or combinations thereof formed using Ni, Mo, Ti, Cr and the like under a deposition condition and the like set by those skilled in the art.

The darkening pattern preferably has a pattern form having the same or a larger line width than the line width of the conductive heating pattern.

When the darkening pattern has a pattern form having a larger line width than the line width of the conductive heating pattern, an effect of the darkening pattern shielding the conductive heating pattern may be more greatly provided when users see, which leads to an advantage of efficiently blocking an effect obtained by gloss or reflection of the conductive pattern itself. However, target effects of the present specification may be accomplished even when the darkening pattern has the same line width as the conductive pattern.

The method for manufacturing a heating element may further include forming bus bars provided on both ends of the conductive heating pattern. In addition, the method for manufacturing a heating element may further include forming a power supply unit connected to the bus bar.

The bus bar and the power supply unit may be formed on the adhesive film either simultaneously or consecutively with the conductive heating pattern, or may be formed on a transparent substrate of an end product separately from the conductive heating pattern.

The method for manufacturing a heating element may further include forming a black pattern on the transparent substrate of the end product in order to conceal the bus bar.

The forming of a conductive heating pattern on the bonding film may include bonding the conductive heating pattern on the bonding film by laminating the conductive heating pattern-provided adhesive film on the bonding film.

According to one embodiment of the present disclosure, the metal pattern being favorably formed on the bonding layer is identified through sheet resistance and current measurements when laminating the bonding film and the adhesive film at [glass transition temperature of bonding film−10° C.] or higher and, as necessary, [temperature used in a bonding process with transparent substrate] or lower under vacuum and pressure, changing adhesive strength of the adhesive film by an external stimulus, and removing the adhesive film after.

According to one embodiment of the present disclosure, when the bonding film and the adhesive film are laminated by being passed through a heating roll at [glass transition temperature of bonding film−10° C.] or higher and, as necessary, [temperature used in a bonding process with transparent substrate] or lower, the area of contact between the bonding film and the adhesive film increases compared to when laminating the bonding film and the adhesive film at lower than [glass transition temperature of bonding film−10° C.]. This is due to the fact that, by performing lamination of passing through a heating roll at [glass transition temperature of bonding film−10° C.] or higher and, as necessary, [temperature used in a bonding process with transparent substrate] or lower, for example, 150° C. or lower when preparing a composite film of bonding film/adhesive film, the part of the bonding film surface adjoining the adhesive film melts, and as a result, the area of contact between the conductive heating pattern and the bonding film may increase, and bonding strength may increase therefrom. Accordingly, in the heating element according to one embodiment of the present disclosure, the area of the bonding film adjoining the conductive heating pattern may increase compared to when laminating the bonding film and the conductive heating pattern at lower than [glass transition temperature of bonding film−10° C.].

The lamination method is not particularly limited, and specifically, both roll lamination and lamination in a sheet state may both be used. However, temperatures, contact times, pressures and the like may be different when laminating in a roll state and a sheet state.

When the forming of a conductive heating pattern is bonding the conductive heating pattern on the bonding film by laminating the conductive heating pattern-provided adhesive film on the bonding film, the conductive heating pattern on the adhesive film may be embedded to the bonding film side when laminating the bonding film on one surface of the adhesive film provided with the conductive heating pattern. Specifically, the bonding film completely covers the conductive heating pattern in a region with the conductive heating pattern, and is bonded to the adhesive film in a region without the conductive heating pattern, and the conductive heating pattern on the adhesive film may be sealed by the bonding film so that there is almost no space between the conductive heating pattern-provided adhesive film and the bonding film.

The forming of a conductive heating pattern on the bonding film may include applying an external stimulus to the adhesive film.

When bonding the bonding film on one surface of the adhesive film provided with the conductive heating pattern, adhesive strength is reduced by applying an external stimulus to the adhesive film either before or after the bonding, and by removing the adhesive film after bonding to the bonding film, only the conductive heating pattern may be transferred on the bonding film.

The external stimulus may be one or more of heat, light irradiation, a pressure and a current, and the external stimulus may be light irradiation, and may preferably be ultraviolet irradiation.

The ultraviolet irradiation may be carried out with light in an ultraviolet wavelength region with a range of 200 nm to 400 nm. Ultraviolet irradiation dose may be greater than or equal to 200 mJ/cm$^2$ and less than or equal to 1200 mJ/cm$^2$, and preferably greater than or equal to 200 mJ/cm$^2$ and less than or equal to 600 mJ/cm$^2$.

The forming of a conductive heating pattern on the bonding film may include removing the adhesive film.

The method of removing the adhesive film is not particularly limited as long as it is capable of removing the adhesive film. For example, the adhesive film may be removed manually, or removed using a roll device.

When, after laminating the bonding film on one surface of the adhesive film provided with the conductive heating pattern, the adhesive film is removed and only the heating pattern is transferred on the bonding film, a heating element in which the conductive heating pattern is embedded to the bonding film side may be stored, moved or dealt. A protective film (or a release film) to be removed later may be further included on at least one surface of the heating element, and the heating element provided with the protective film (or the release film) may be stored, moved or dealt while being wound in a roll in this state.

The laminating of a transparent substrate may include laminating a transparent substrate on at least one surface of both surfaces of the bonding film provided with the conductive heating pattern, and specifically, may be consecutively or simultaneously laminating a transparent substrate on both surfaces of the bonding film provided with the conductive heating pattern.

The transparent substrate means a transparent substrate of an end product to use a heating element, and for example, the transparent substrate may be a glass substrate, preferably may be automotive glass, and more preferably automotive front glass.

A method for manufacturing a heating element according to another embodiment of the present specification may include preparing a first bonding film; forming a conductive heating pattern on the first bonding film; and, by laminating a second bonding film and a transparent substrate on the first bonding film, bonding the second bonding film on a surface opposite to the surface provided with the conductive heating pattern of the first bonding film.

A method for manufacturing a heating element according to another embodiment of the present specification may include preparing a first bonding film; forming a conductive heating pattern on the first bonding film; and forming a second bonding film on the surface provided with the conductive heating pattern of the first bonding film.

The first and the second bonding films may have compositions the same as or different from each other.

When the first and the second bonding films have the same composition, because the glass transition temperatures are the same, and the same lamination condition may be applied when bonding the conductive heating pattern provided on the adhesive film with the bonding film. Since the two bonding films have the same composition, thermal driving properties such as contraction and expansion by heat are the same, which is advantageous in maintaining original pattern properties.

When the first and the second bonding films have different compositions, different properties as well as heating properties may be obtained through the different compositions, and for example, additional properties such as noise control, IR protection and UV protection may be added thereto.

The first and the second bonding films may have differences in the bonding auxiliary types, addition of additives, and the content of additives.

The bonding film may include additives including at least one of a coloring agent, a UV absorbent, a lubricant, an antistatic agent, a stabilizer and a noise control agent.

The first and the second bonding films may each include two or more bonding layers. In this case, the bonding layers may have compositions the same as or different from each other.

The method for manufacturing a heating element may further include forming a protective film on the surface provided with the conductive heating pattern of the bonding film after the forming of a conductive heating pattern. Specifically, as necessary in terms of a process or depending on uses in final applications, the heating element may be moved or dealt while attaching a protective film (or a release film) to be removed later without attaching a transparent substrate. As types of the protective film, those known in the art may be used, and examples thereof may include plastic films, plastic films coated with release materials, papers, papers coated with release materials, or films of which surfaces are embossing treated.

The heating element provided with the protective film on the surface of bonding film provided with the conductive heating pattern may be stored, moved or dealt while being wound in a roll. Herein, the heating element may be wound in a roll so that the surface provided with the conductive heating pattern of the bonding film is positioned relatively on an inner side or positioned on an outer side. The surface provided with the conductive heating pattern of the bonding film being positioned relatively on an outer side, specifically, the heating element being wound in a roll so that the protective film provided on the surface provided with the conductive heating pattern of the bonding film is positioned on an outermost side is advantageous in maintaining pattern properties.

One embodiment of the present specification provides a heating element including a bonding film; and a conductive heating pattern provided on the bonding film.

The conductive heating pattern may be in a state that only all or a part of an upper surface of the conductive heating pattern is exposed and the rest is embedded to the bonding film side. Specifically, all or a part of one surface of the conductive heating pattern is exposed to the outside without being covered by the bonding film, and the remaining surface of the conductive heating pattern may be covered by the bonding film.

The heating element may be stored, moved or dealt while the conductive heating pattern is embedded to the bonding film side. A protective film (or a release film) to be removed later may be further included on at least one surface of the bonding film provided with the conductive heating pattern, and the heating element may be stored, moved or dealt while being wound in a roll in this state.

As for descriptions on the heating element, the descriptions thereon provided above may be used.

The bonding film may be two or more bonding films. Specifically, the bonding film may include a first bonding film and a second bonding film provided on the first bonding film.

The two or more bonding films may have compositions the same as or different from each other.

The first and the second bonding films may each include two or more bonding layers. In this case, the bonding layers may have compositions the same as or different from each other.

As for descriptions on the bonding film and the conductive heating pattern, the descriptions thereon provided above may be used.

The heating element may further include a release film provided on at least one surface of the bonding film provided with the conductive heating pattern.

The heating element may include a release film; two or more bonding films provided on the release film; and a conductive heating pattern provided on the bonding film.

The heating element may include a first release film; two or more bonding films provided on the first release film; a conductive heating pattern provided on the bonding film; and a second release film provided on the conductive heating pattern.

The heating element provided with the release film on the surface provided with the conductive heating pattern of bonding film may be stored, moved or dealt while being wound in a roll. Herein, the heating element may be wound in a roll so that the surface provided with the conductive heating pattern of the bonding film is positioned relatively on an inner side or positioned on an outer side. The surface provided with the conductive heating pattern of the bonding film being positioned relatively on an outer side, specifically, the heating element being wound in a roll so that the protective film provided on the surface provided with the conductive heating pattern of the bonding film is positioned on an outermost side is advantageous in maintaining pattern properties.

As for descriptions on the release film, the descriptions thereon provided above may be used.

The heating element may further include a transparent substrate provided on at least one surface of the bonding film provided with the conductive heating pattern.

The heating element may include a transparent substrate; two or more bonding films provided on the transparent substrate; and a conductive heating pattern provided on the bonding film.

The heating element may include a first transparent substrate; two or more bonding films provided on the first transparent substrate; a conductive heating pattern provided on the bonding film; and a second transparent substrate provided on the conductive heating pattern.

The heating element may include two or more bonding films; a conductive heating pattern provided on the bonding film; and a transparent substrate provided on the conductive heating pattern.

As for descriptions on the transparent substrate, the descriptions thereon provided above may be used.

The heating element may further include an adhesive film provided on the conductive heating pattern, and having an adhesive strength decrement of 30% or greater by an external stimulus based on adhesive strength before the external stimulus.

The heating element may include two or more bonding films; and a conductive heating pattern provided on the bonding film; and an adhesive film having an adhesive strength decrement of 30% or greater by an external stimulus based on adhesive strength before the external stimulus.

The adhesive film is a film having adhesive strength controlled by an external stimulus, and specifically, may be a film having adhesive strength decreased by an external stimulus. The adhesive film may have an adhesive strength decrement of 30% or greater by an external stimulus based on adhesive strength before the external stimulus, and specifically, the adhesive film may have an adhesive strength decrement of greater than or equal to 30% and less than or equal to 100% by an external stimulus based on adhesive strength before the external stimulus, and more specifically, the adhesive film may have an adhesive strength decrement of greater than or equal to 95% and less than or equal to 100% by an external stimulus based on adhesive strength before the external stimulus.

A composition for forming the adhesive film is not particularly limited, and for example, the adhesive composition may include an adhesive resin, an initiator and a crosslinking agent as described above for the adhesive composition, and may further include an ultraviolet curable compound.

In the adhesive film formed with the adhesive composition, some of functional groups in the adhesive resin, the crosslinking agent and the ultraviolet curable compound bond to maintain minimal mechanical strength for maintaining the film, however, the functional groups remain so as to proceed with additional reactions. When applying an external stimulus for reducing adhesive strength of the adhesive film, the remaining functional groups initiated by an initiator form additional crosslinking, and as a result, the adhesive film becomes hard reducing adhesive strength.

The heating element may further include a substrate provided on a surface opposite to the surface provided with the conductive heating pattern of the adhesive film.

The heating element may include two or more bonding films; a conductive heating pattern provided on the bonding film; an adhesive film having an adhesive strength decrement of 30% or greater by an external stimulus based on adhesive strength before the external stimulus; and a substrate.

As for descriptions on the adhesive film, the descriptions thereon provided above may be used.

The heating element may further include a darkening pattern provided at least one of on the conductive heating pattern and between the conductive heating pattern and the bonding film.

As for descriptions on the darkening pattern, the descriptions thereon provided above may be used.

The heating element may further include bus bars provided on both ends of the conductive heating pattern.

The heating element may further include a power supply unit connected to the bus bar.

According to embodiments described in the present specification, the conductive heating pattern may be formed on a transparent substrate of an end product so that a transparent base for forming the conductive heating pattern does not remain in the end product. As described above, by an adhesive film being removed, films other than a bonding film used for bonding transparent substrates of an end product may not be additionally used between the two transparent substrates of the end product, and view distortions caused by refractive index differences between the films may be prevented.

The heating element according to the present disclosure may be connected to a power supply for heating, and herein, the heating value may be from 100 W to 1000 W per $m^2$ and preferably from 200 W to 700 W per $m^2$. The heating element according to the present disclosure has excellent heating performance even at low voltages, for example, 30 V or less and preferably 20 V or less, and therefore, is useful in automobiles and the like. Resistance in the heating element is 2 ohm/square or less, preferably 1 ohm/square or less and more preferably 0.5 ohm/square or less. The resistance value obtained herein has the same meaning as sheet resistance.

According to another embodiment of the present disclosure, the heating element may be a heating element for automotive glass.

According to another embodiment of the present disclosure, the heating element may be a heating element for automotive front glass.

Hereinafter, the present specification will be described in more detail with reference to examples. However, the following examples are for illustrative purposes only, and not to limit the present specification.

EXAMPLE

Example 1

A copper pattern formed on an adhesive film was placed in a hot laminator together with a polyvinyl butyral (PVB) film, and laminated for 20 minutes at 100° C. under vacuum to bond the copper pattern to the bonding film. The adhesive film was removed after reducing adhesive strength of the adhesive film through ultraviolet irradiation, and it was checked that only the copper pattern was bonded to the PVB. After placing the copper pattern-transferred bonding film between two sheets of glass, the result was placed in a hot laminator, and the glass and the bonding film were bonded for 30 minutes at 140° C. When observing a heating element, a final product, using a microscope, it was identified that the copper pattern was maintained on the bonding film.

Example 2

A copper pattern formed on an adhesive film was placed in a hot laminator together with a polyvinyl butyral (PVB) film, and laminated for 20 minutes at 100° C. under vacuum to bond the copper pattern to the bonding film. The adhesive film was removed after reducing adhesive strength of the adhesive film through ultraviolet irradiation, and it was checked that only the copper pattern was bonded to the PVB. After preparing the copper pattern-transferred bonding film, a bonding film having the same composition was additionally prepared. After placing the two bonding films between two sheets of glass, the result was placed in a hot laminator, and the glass and the bonding films were bonded for 30 minutes at 140° C. When observing a heating element, a final product, using a microscope, it was identified that the copper pattern was maintained on the bonding film.

Example 3

A copper pattern formed on an adhesive film was placed in a hot laminator together with a polyvinyl butyral (PVB) film, and laminated for 20 minutes at 100° C. under vacuum to bond the copper pattern to the bonding film. The adhesive film was removed after reducing adhesive strength of the adhesive film through ultraviolet irradiation, and it was checked that only the copper pattern was bonded to the PVB. After preparing the copper pattern-transferred bonding film, a bonding film having a different composition was additionally prepared. After placing the two bonding films between two sheets of glass, the result was placed in a hot laminator, and the glass and the bonding films were bonded for 30 minutes at 140° C. When observing a heating element, a final product, using a microscope, it was identified that the copper pattern was maintained on the bonding film.

Comparative Example 1

Using a substrate provided with Cu film of 2 μm on a general PET substrate through a plating method, an etching protective pattern made of a novolac resin as a main component was formed on the copper film using a reverse offset printing process. After additionally drying the result for 5 minutes at 100° C., the copper in the exposed portion was etched through an etching process, and as a result, a copper pattern was formed on the general PET. After placing the copper pattern-formed PET substrate between two sheets of bonding films, and together with two sheets of glass, the glass and the bonding film, and the bonding film and the PET substrate were bonded for 30 minutes at 140° C.

Experimental Example 1

Results of observing the copper patterns prepared in Examples 1 to 3 using an optical microscope are shown in FIG. 7.

Experimental Example 2

Optical properties of the heating element manufactured using a general heating film in Comparative Example 1 and the heating element of Example 1 are compared in the following Table 1.

TABLE 1

| | Transmittance | Haze | Yellow Index b* |
|---|---|---|---|
| Example 1 | 84.03 | 1.80 | 0.80 |
| Example 2 | 84.43 | 1.81 | 0.96 |
| Comparative Example 1 | 80.17 | 1.84 | 2.18 |

Through Table 1, it was identified that Example 1 with the PET substrate removed had excellent optical properties compared to Comparative Example 1, and it was identified that distortions caused by refractive index differences and a visibility problem were improved.

The invention claimed is:

1. A method for manufacturing a heating element comprising:

preparing a first bonding film;

forming a conductive heating pattern on the first bonding film; and laminating a second bonding film and a transparent substrate on the first bonding film, wherein the second bonding film is disposed on a surface opposite to the surface provided with the conductive heating pattern of the first bonding film, wherein the forming of the conductive heating pattern on the first bonding film comprises:

preparing an adhesive film provided with a conductive heating pattern and having an adhesive strength decrement of 30% or greater by an external stimulus based on adhesive strength before the external stimulus;

bonding the conductive heating pattern on the first bonding film by laminating the conductive heating pattern-provided adhesive film on the first bonding film;

applying an external stimulus to the adhesive film; and removing the adhesive film.

2. The method for manufacturing a heating element of claim 1, wherein the external stimulus is one or more of heat, light irradiation, a pressure and a current.

3. The method for manufacturing a heating element of claim 1, wherein the external stimulus is ultraviolet irradiation.

4. The method for manufacturing a heating element of claim 1, wherein the preparing of an adhesive film provided with a conductive heating pattern comprises:

forming an adhesive film on a substrate;

forming a conductive heating pattern on the adhesive film; and forming a darkening pattern at least one of before and after the forming of a conductive heating pattern on the adhesive film.

* * * * *